United States Patent [19]

Crossman et al.

[11] Patent Number: 4,948,198

[45] Date of Patent: Aug. 14, 1990

[54] KNEE-TILT CHAIR CONTROL

[75] Inventors: Philip Crossman, Holland; Kenneth C. Hybarger, Belmont; Bryan H. Zeeuw, Lowell; David A. Young, Grand Rapids, all of Mich.

[73] Assignee: Leggett & Platt, Incorporated, Carthage, Mo.

[21] Appl. No.: 258,172

[22] Filed: Oct. 14, 1988

[51] Int. Cl.[5] ..... A47C 3/026

[52] U.S. Cl. ..... 297/304; 297/302; 297/305

[58] Field of Search ..... 297/300, 304, 305, 301, 297/302; 248/561, 372.1

[56] References Cited

U.S. PATENT DOCUMENTS

| | | | |
|---|---|---|---|
| 2,321,385 | 6/1943 | Herold . | |
| 2,646,839 | 7/1953 | Hillman . | |
| 2,687,166 | 8/1954 | Hamilton . | |
| 2,729,273 | 1/1956 | Hamilton et al. . | |
| 2,859,799 | 11/1958 | Moore . | |
| 3,480,249 | 11/1969 | Lie . | |
| 3,627,252 | 12/1971 | Yamaguchi . | |
| 4,099,775 | 7/1978 | Mizelle . | |
| 4,189,179 | 2/1980 | De Graaf . | |
| 4,270,797 | 6/1981 | Brauning | 297/305 |
| 4,384,741 | 5/1983 | Flum et al. . | |
| 4,390,206 | 6/1983 | Faiks et al. | 297/300 |
| 4,438,898 | 3/1984 | Knoblauch et al. . | |
| 4,555,085 | 11/1985 | Bauer et al. . | |
| 4,711,491 | 12/1987 | Ginat . | |
| 4,743,065 | 5/1988 | Meiller et al. | 297/300 |

*Primary Examiner*—Peter R. Brown

*Attorney, Agent, or Firm*—Wood, Herron & Evans

[57] ABSTRACT

A low profile knee-tilt chair control for controlling biased tilting between a chair seat plate and a chair base plate of a pedestal base chair wherein the chair base plate is supported by a single vertical spindle at the rear of the base plate, and the chair seat plate pivots about a horizontal axis at the front of the base plate. The chair seat is biased to an at-rest position by a low profile, conical helical compression spring operable between the base plate and chair seat and located between the spindle and the horizontal pivot axis of the base plate. The low profile, conical helical compression spring is so mounted relative to the base plate and chair seat plate that the small coils of the compression spring may pass through the large coils during compression of the spring. The control is further characterized by a lock-out for securing the chair seat plate against tilting relative to the base plate in either of two different, selectable, at-rest positions.

21 Claims, 5 Drawing Sheets

KNEE-TILT CHAIR CONTROL

This invention relates to pedestal base chairs, and more particularly, to an improved chair control for use in connection with such chairs.

Pedestal base chairs typically comprise a base, a spindle or post extending upwardly from the base, a chair control mounted atop the spindle, and a chair seat mounted for pivotal or tilting movement atop the chair control. Traditionally, such pivoting movement of the chair seat has occurred against a spring bias and about an axis located approximately midway between the front and back of the seat or nearer the back of the seat.

Recently, there have been developed a number of chair controls wherein the pivotal movement of the seat occurs about a horizontal axis located near the front of the seat. Such chair controls have been identified as knee-tilt chair controls because they pivot about an axis located near the knee of a person seated in the chair.

A knee-tilt chair, like any other pedestal base chair, functions to provide a comfortable seat for an individual in a normal, erect working position at a desk or table and to provide the option of reclining the chair seat from time to time to obtain some relief from the strain of maintaining the erect position. Typical chair controls of the type which preceded knee-tilt controls were pivoted about a horizontal axis at or near the front-to-back center line of the chair seat. This location of the pivot axis was near the front-to-back center of gravity of the chair occupant. Accordingly, tilting of the chair backward required very little counterforce or spring force, but it resulted in the front of the chair seat being lifted or raised, creating a pressure on the back of the thigh, which pressure disturbed blood circulation and required the occupant to exert considerable force through extension of the legs and toes to maintain the tilted position. Knee-tilt chair controls, on the other hand, have the pivot axis located forwardly near the knee joint pivot point so that the front of the seat rises very little or not at all in the course of the chair seat and back's being tilted or tipped rearwardly. With a larger portion of the chair occupant's weight distributed behind the pivot, little or no effort is required to maintain a tipped or reclined position, and the chair occupant's feet remain flat on the floor with very little effort being required to maintain that position.

But, a problem characteristic of all knee-tilt chair controls is that they require a much greater spring force to support the chair occupant on the much longer moment arm between the chair occupant's center of gravity and the chair seat pivot axis, and they require a much greater force to return the chair occupant to the erect position from a tilted position. Conventional springs providing such force are very massive and visually awkward, extending far below the chair or, in the case of torsion bar type springs, extending far from the sides in a most conspicuous manner. Aggravating this situation is the fact that the travel or working length and tension required of a knee-tilt chair control are much greater than those of the traditional controls wherein the pivot of the seats were located closer to the front-to-rear center line of the seat. Past solutions to these problems in knee-tilt chair controls have generally required the use of multiple, heavy-duty springs and/or complex and expensive mechanical linkages to minimize the bulk of the springs.

Yet another problem characteristic of prior art knee-tilt chair control mechanisms derives from the vertical height required in the knee-tilt control to accommodate large travel of the rear of the chair seat during tilting movement of the seat about an axis located at the front of the seat; for example, 20° of tilting movement on a seven-inch moment arm required over two inches of clearance or travel of the rear of the seat. Accordingly, the vertical space required in the control for this vertical height movement reduces by that amount the space available for spindle attachment and chair height adjustment hardware.

It has therefore been an objective of this invention to provide an improved knee-tilt chair control which provides the greater spring force required of such a control by a single spring and at a minimal cost.

Still another objective of this invention has been to provide a knee-tilt chair control which permits large travel of the seat with a control of minimum height and minimum vertical profile.

These objectives are achieved by the knee-tilt chair control mechanism of this invention which comprises a forwardly and upwardly inclined base plate mounted at the rear upon a spindle of a chair base and a chair seat plate pivotally mounted on the base plate near the front of the base plate and approximately seven inches forward of the spindle attachment of the base plate to the spindle. The chair seat plate is biased upwardly by a conical helical compression spring whose largest half coil is seated on the seat plate in such a fashion that the center of the coil spring is left open to pass the inner coils during full travel of the seat plate relative to the base plate. The smaller diameter end of the conical helical compression spring is supported against the base plate of the chair control by a spring adjustment bearing plate, which is in turn pivotally supported on a spring adjustment control nut. This nut is in turn threadedly supported on the upper end of a screw which projects through the base plate. The lower end of the screw has an external knob mounted thereon for manual adjustment of the screw to adjust the preload compression force of the spring.

In the preferred embodiment of the chair control, there is a bumper located between the seat plate and the base plate forwardly of the pivot axis between the seat plate and base plate. This bumper is of an appropriate thickness so that the seat plate assumes a desired at-rest angle, usually between 0° and 5°, for a particular chair. The chair is biased by the conical helical spring to this at-rest position. In the preferred embodiment of the invention, this bumper is adjustable by rotation of the bumper between two positions, in one position at which it provides a 0° or horizontal at-rest position of the seat, and in the other position at which it provides a rearwardly tilted rest angle of 5°.

The chair control also preferably includes a lockout for securing the chair against tilting movement in either the 0° or 5° at-rest position. This lockout comprises a pawl mounted upon the end of a lever arm and engageable with a striker secured to the seat plate such that the pawl is movable to a position between the striker and the base plate to lock the seat plate against rearward tilting movement. The lockout control lever arm extends from one side of the chair. A second lever arm preferably extends out from the opposite side of the chair and is secured to a second pawl, which second pawl is operable to engage a top activator button of a gas cylinder of the spindle to control extension and retraction of the spindle, and thus raising and lowering of the seat.

The primary advantage of the invention of this application is that it provides a low profile, knee-action chair control as a consequence of the utilization and location of the conical helical spring in the control. This spring provides the large force required in a knee-action chair control, along with the adjustability of that force. It also provides the travel required for a knee-action chair control in a relatively small height without complex and expensive devices to translate the forces in other directions. It also permits adjustable and adequate preload so that the "breakaway" torque which must support the occupant of the chair in an erect position lies in the linear range of this spring's performance curve, preventing excessive force buildup at the rear of the spring travel.

These and other objects and advantages of this invention will be more readily apparent from the following description of the drawings in which.

Figures 5, 5A:
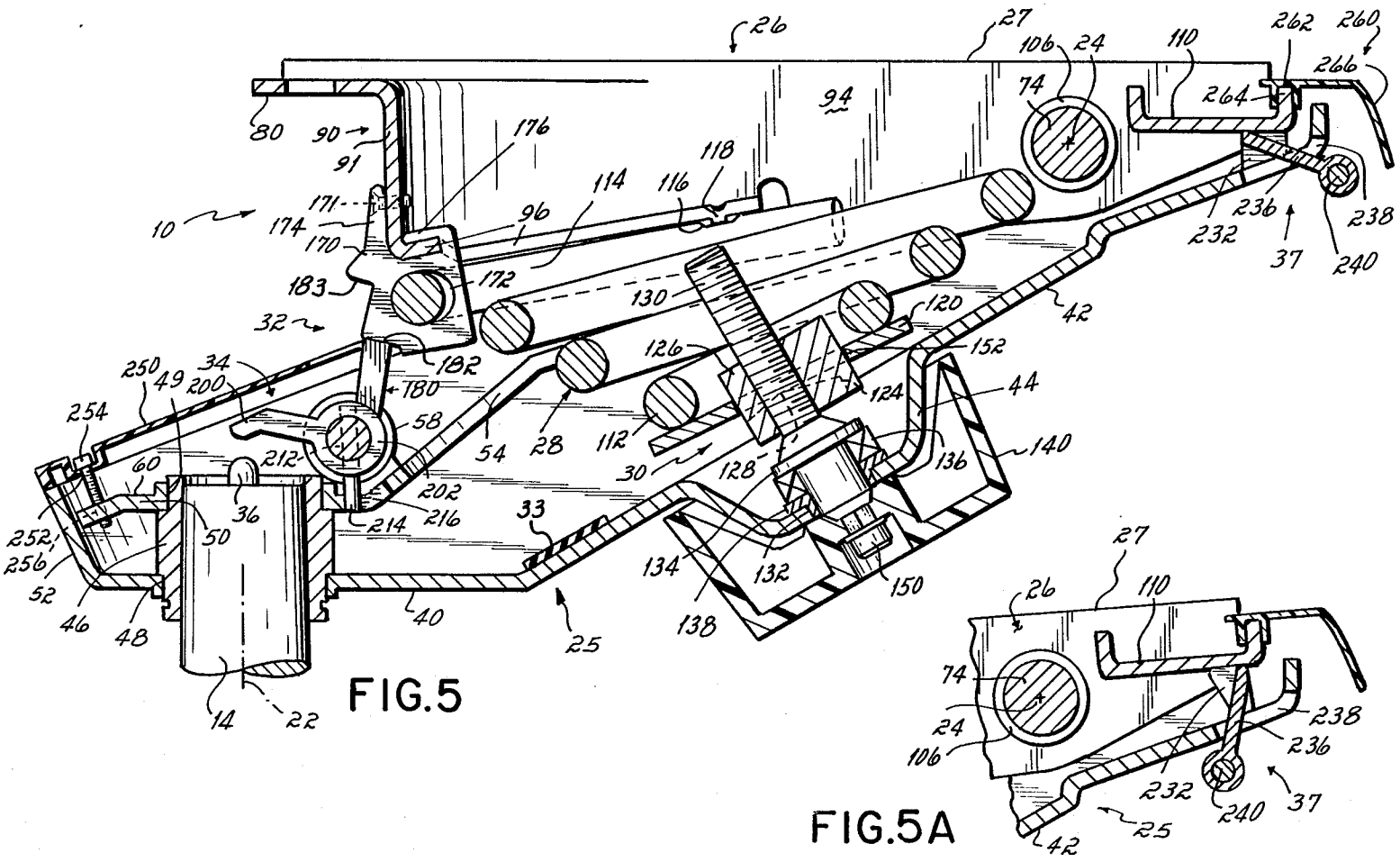
FIG. 5 is a cross-sectional view of the chair control taken on line 5—5 of FIG. 3.

FIG. 5A a cross-sectional view of the front portion of the chair control of FIG. 5, but illustrating the tilt angle adjustment means in a second position of the tile angle adjustment means.

Figure 6:
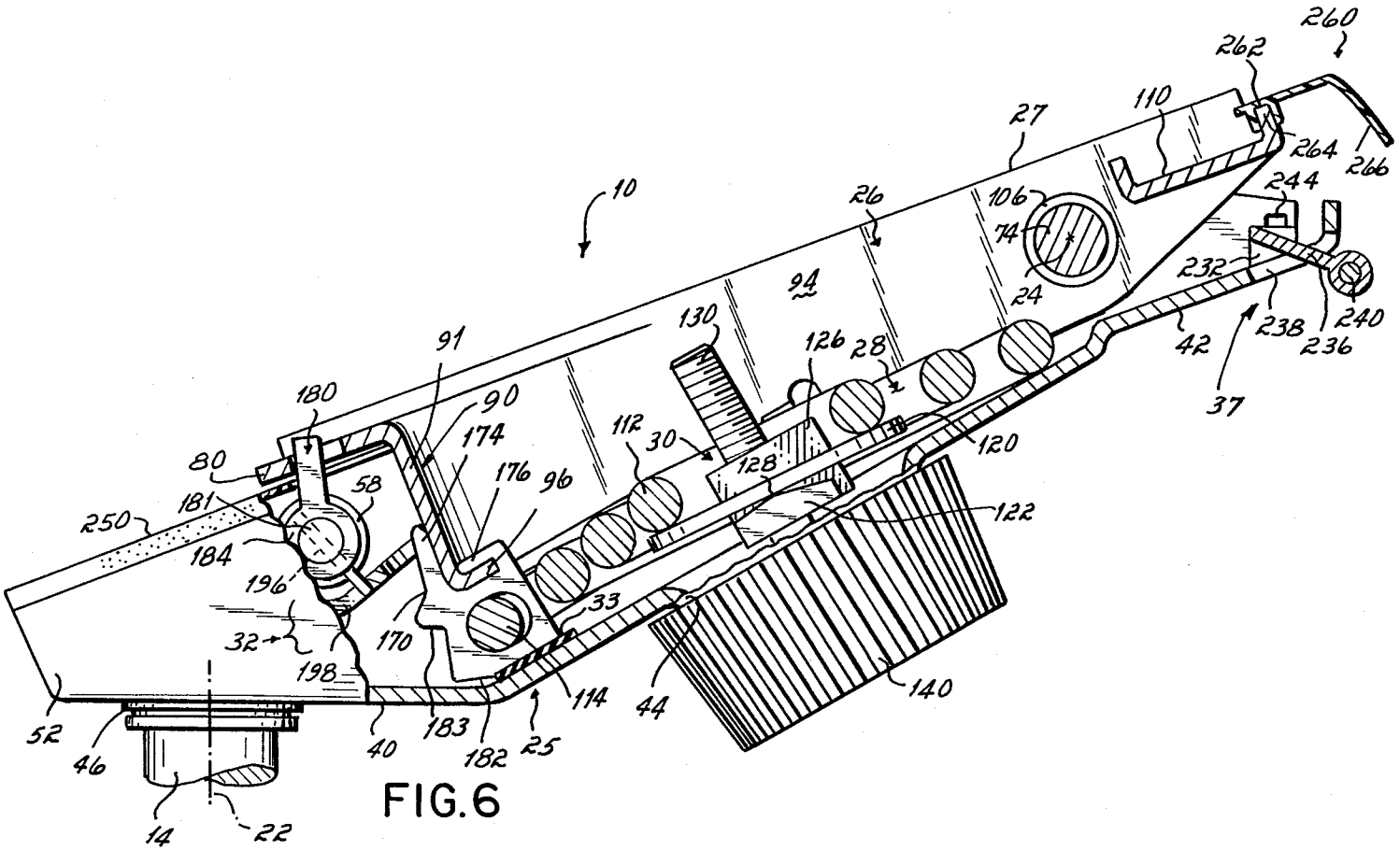

FIG. 6 is a view similar to FIG. 5, but showing the spring compressed.

Figure 1:
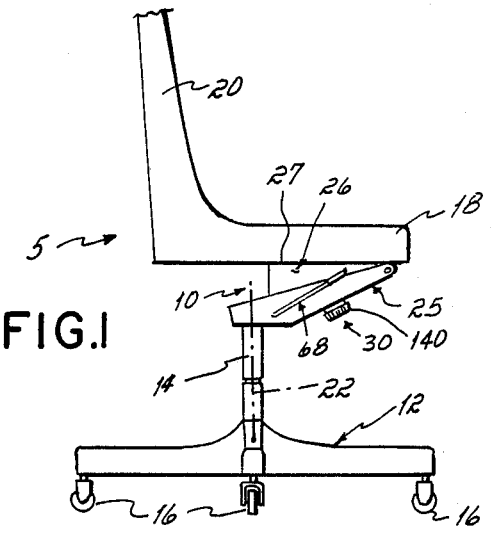
FIG. 1 is a side elevational view of a chair embodying the invention of this application.
Figure 2:
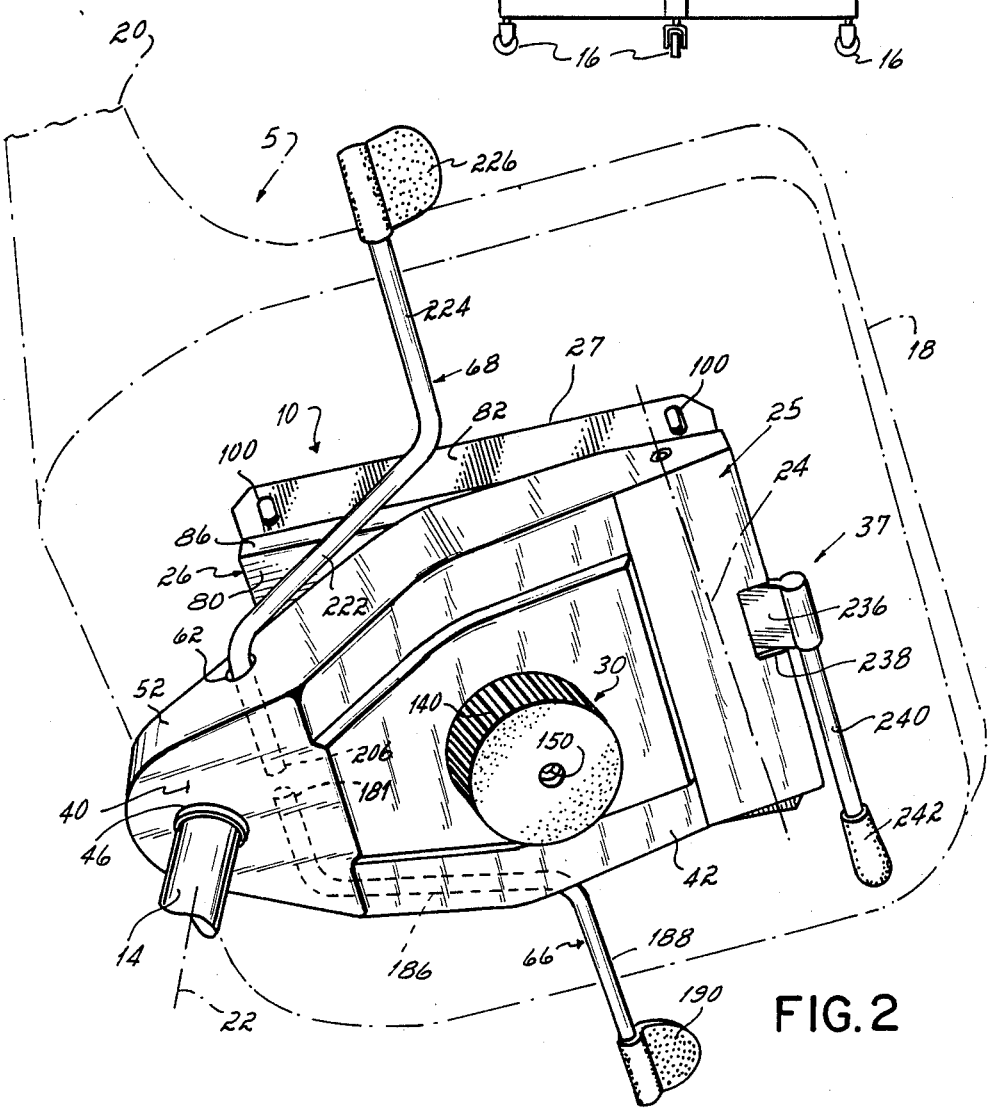
FIG. 2 is a perspective view of the underside of the chair seat and control.
Figure 3:
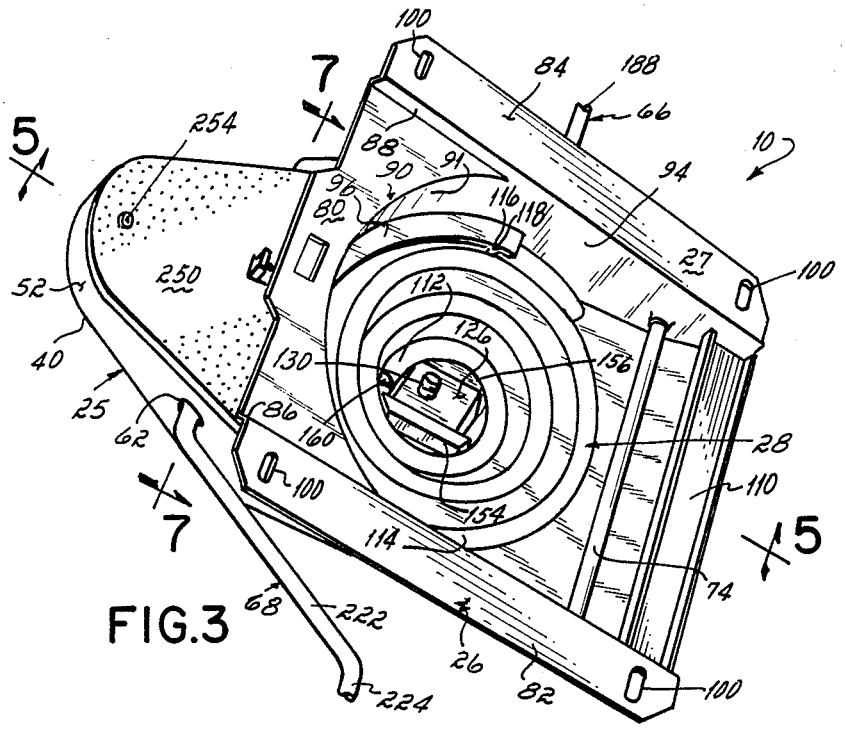
FIG. 3 is a top perspective view of the chair control of the chair of FIG. 1.
Figure 7:
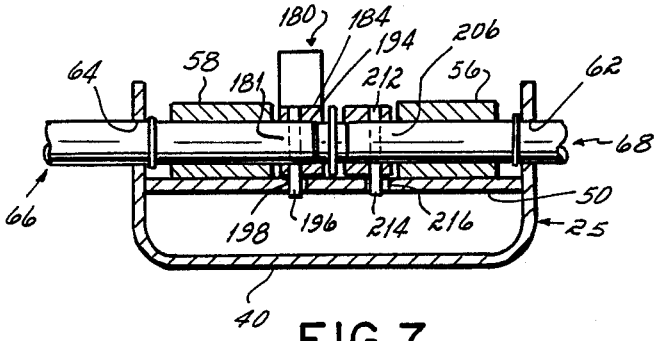

FIG. 7 is a cross-sectional view taken on line 7—7 of FIG. 3.

The novel knee-tilt chair control 10 of this invention is applied to a pedestal base chair 5 having a base 12 from which a spindle 14 extends upwardly. The base 12 is conventionally mounted upon casters 16. The control 10 is mounted atop the spindle. Supported from the chair control 10 is a chair seat 18 and backrest 20. The seat and backrest are interconnected such that a person seated in the chair may lean back against the backrest and tilt the chair seat relative to the vertical axis 22 of the spindle 14. This pivotal movement of the seat and backrest occurs about a horizontal axis 24 located at the front of the chair control 10.

The chair control 10 basically comprises a base plate 25 mounted atop the spindle 14, a seat plate 26 pivotally mounted upon the base plate 25 for pivotal movement about the pivot axis 24, and a compression spring 28 operable between the two plates to bias them apart and toward an at-rest position of the seat plate relative to the base plate. There is a spring preload adjustment means 30 operably connected to the spring for adjusting the preload force of the spring, which preload force determines the breakaway torque which the chair occupant must exert in order to cause the chair seat to move away from its at-rest position toward a rearwardly tilted position and the force required to effect tilting travel of the chair seat. In addition, the chair control 10 includes a lockout means 32 for preventing tilting movement of the seat plate relative to the seat base plate, irrespective of the breakaway torque applied to the back by a chair occupant. The control 10 also includes gas actuator means 34 for actuating an activator button 36 of a gas cylinder (not shown) of the spindle for effecting extension and retraction of the spindle so as to raise and lower the chair control and seat relative to the base. The control 10 also includes a tilt angle adjustment means 37 for varying the at-rest angulation of the seat plate relative to the base plate between a 0° tilt, whereat the seat plate is generally horizontal, and a 5° rearwardly tilt position, whereat the seat plate is angled downwardly and rearwardly by 5° relative to the horizontal.

Base Plate

Figure 4:
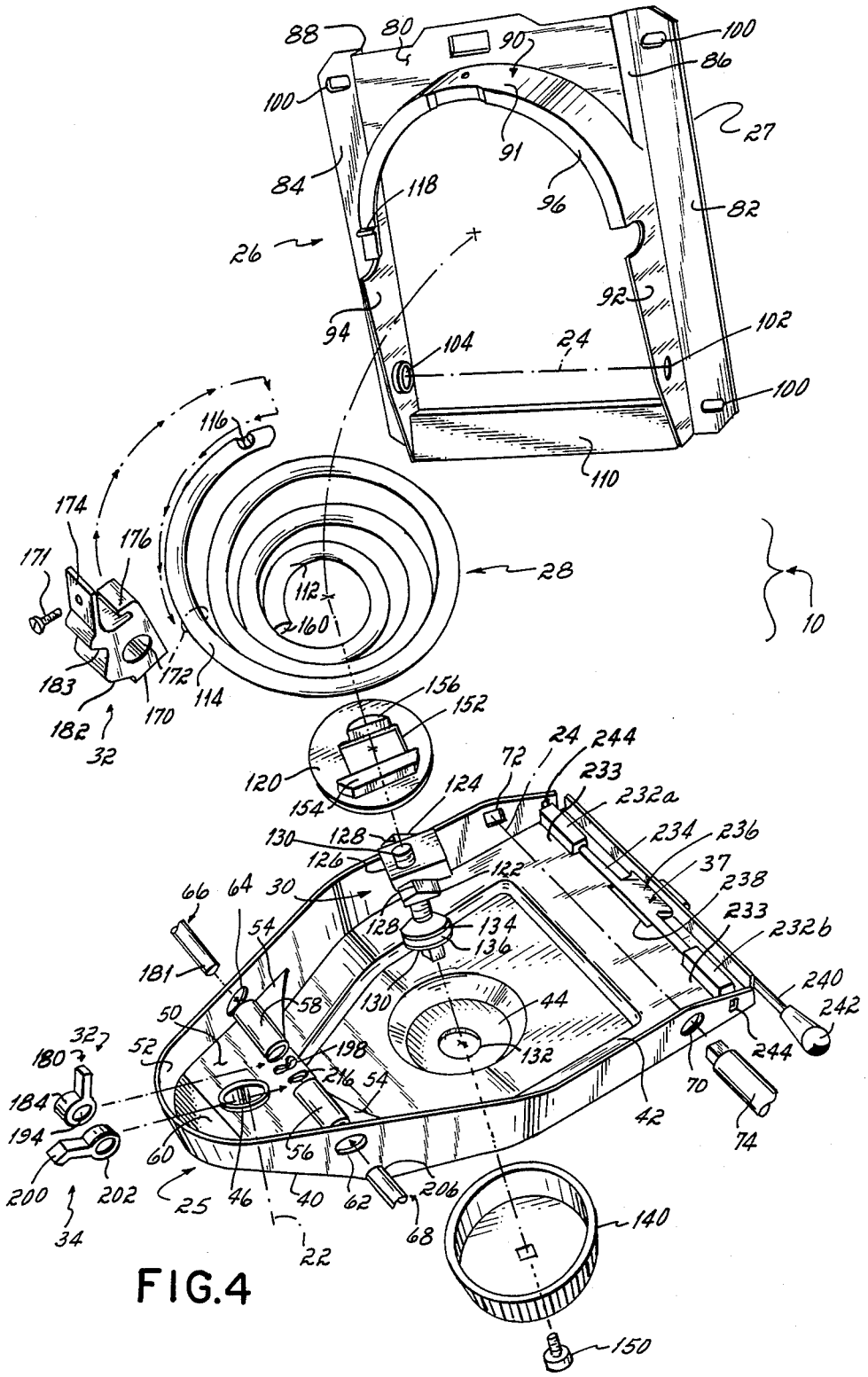
FIG. 4 is an exploded perspective view of the chair control of the chair of FIG. 1.

The base plate 25 is best illustrated in FIGS. 4 and 5. With reference to these Figures, it will be seen that the base plate comprises a sheet metal stamping having a generally horizontal rear section 40 from which a forward section 42 extends upwardly and forwardly at an angle of approximately 30° relative to the rear section. The upwardly inclined forward section has a cup-shaped depression 44 formed therein for reception of the spring preload adjustment means 30, as is explained more fully hereinafter.

There is a flange 52 which extends upwardly from both the front and rear sections of the base plate. This flange 52 supports a gusset plate 50 which is welded to the flange and extends generally parallel to the rear section of the base plate. In order to enable the base plate to be mounted atop the spindle 14, a tapered bushing 46 is sandwiched between a vertical bore 48 of the rear section 40 of the base plate and a vertical bore 49 of the gusset plate. This sandwiching or clamping of the bushing 46 between the gusset plate 50 and the base plate 25 enables the bushing to be secured to the base plate without any welding of the bushing and possible resulting weakening of the connection.

In the illustrated embodiment, the bushing 46 is a tapered bushing. It could as well be any type of bushing or mounting means for securing the control 10 to the top of a spindle or pedestal base post.

The gusset plate generally extends parallel to the rear section 40 of the base plate, but has upstanding wings 54 which extend upwardly and outwardly at the opposite sides of the gusset plate. These wings 54 are welded at their outer edges to the upstanding flange 52 of the base plate.

The gusset plate 50, in addition to supporting the upper end of the bushing 46, also supports a pair of lever pivot tubes 56, 58, which tubes are welded to the gusset plate at the intersection of the upwardly extending wings 54 and the horizontally extending rear section 60 of the gusset plate. These tubes 56, 58 are aligned with holes or bores 62, 64 in the upstanding flange 52 of the base plate such that actuator levers 66, 68 of the lockout means 32 and gas actuator means 34, respectively, may extend through the holes and through the tubes, as is explained more fully hereinafter.

At the front of the base plate there are a pair of holes 70, 72 formed in the upstanding flange 52 of the base plate. These holes are located on opposite sides of the base plate and are aligned so as to support a seat plate pivot shaft 74. This shaft extends horizontally between the opposite sides of the base plate and supports the seat plate 26 for pivotal movement about the pivot axis 24 of the pivot shaft 74.

Seat Plate

The seat plate 26 is best illustrated in FIGS. 3, 4 and 5. With references to these Figures, it will be seen that the seat plate 26 is also formed from stamped sheet metal. It comprises a rear horizontal section 80, a pair of side horizontal sections 82, 84, a depending flange 90 and a front transverse support channel 110. The rear horizontal section 80 is connected to the side horizontal sections 82, 84 by vertical flanges 86, 88, respectively. The depending flange 90 includes a semi-circular flange section 91 which extends downwardly from the rear horizontal section 80 of the seat plate and is connected to side flange sections 92, 94 of the flange 90. The side flange sections 92, 94 extend downwardly from the side horizontal sections 82, 84 of the seat plate. The lower end of the semi-circular section of the flange 90 terminates in an inwardly turned, semi-circular flange 96, which inwardly turned flange 96 functions as a seat for the upper turn or revolution of the conical helical compression spring 28, as explained more fully hereinafter.

The four corners of the seat plate are provided with apertures 100, which apertures function as bolt holes for enabling a chair seat to be bolted to the top of the seat plate 26. At the front of the side sections 92, 94 of the flange 90, holes 102, 104 are punched from the flanges. These holes are aligned and are adapted to receive bushings 106 which support the seat plate for pivotal movement about the axis 24 of the seat plate support pivot shaft 74.

The transverse support channel 110 extends between the side sections 92, 94 of the flange 90 near the front of the seat plate. The opposite ends of this channel are welded to the side sections 92, 94 of the flange such that the channel functions as a rigidifying support of the seat plate. Additionally, and as explained more fully hereinafter, this transverse support channel 110 functions as a stop between the base plate and the seat plate to define the at-rest position to which the seat plate is biased by the spring 28 relative to the base plate.

Spring Preload Adjustment Means

The spring 28 is a conical helical compression spring of approximately three and one-quarter turns or revolutions. Its smallest turn or revolution is located at the bottom of the spring, and its largest diameter turn or revolution is located at the top of the spring. This large diameter top turn of the spring rests against and is supported by the inwardly turned flange 96 of the seat plate 26. There is preferably a recess 116 machined from the top turn of the spring 28. This recess is receivable over a detent 118 formed in the flange 96 so as to prevent relative sliding movement of the spring relative to the supporting flange.

The bottom turn 112 of the spring rests atop a spring adjustment bearing plate 120, which plate is in turn pivotally supported from wings 122, 124 of an adjustment nut 126. The wings located on opposite sides of the nut are tapered upwardly to a linear bearing point 128 about which the plate 120 is free to rock during compression of the spring 28.

The nut 126 is threadedly received over a spring adjustment screw 130 which extends through a bore 132 in the center of the depression 44 of the base plate 25. This screw 130 has a flange 134 which rests atop and is supported by a thrust bearing 136. The thrust bearing is in turn supported from a bushing 138 mounted in the bore 132 of the base plate.

Mounted over the lower end of the screw on the underside of the base plate there is a cored out adjustment knob 140. The cored out configuration of this knob 140 is such that it minimizes the height of the control 10 by nesting the knob 140 over the cup-shaped depression 44 of the base plate 25 so as to accommodate the lower end of the spring in the lower end of the spring tension setting. The knob thus has sufficient surface area for ease of adjustment without protruding excessively from the bottom of the control. To secure the knob 140 to the screw, the knob 140 has an axial bore of square cross section which fits over a square cross section end of the screw such that rotation of the knob effects rotation of the screw. The adjustment knob 140 is secured to the bottom of the adjustment screw by a small locking screw 150.

The spring adjustment nut 126 passes through a rectangular hole 152 in the spring adjustment bearing plate 120. On the top side of this spring adjustment bearing plate there are abutments 154, 156 which provide upstanding seats for the lower turn 112 of the spring 128. The end 160 of the lower turn 112 of the spring abuts against one of these abutments 154 so as to prevent rotation of the spring relative to the bearing plate upon which it rests. The square cross section of the hole 152 in turn prevents the spring adjustment nut 126 from rotating relative to the spring adjustment plate through which it passes and upon which the plate rests. As a consequence of this construction of the spring preload adjustment means 30, rotation of the adjustment knob 140 is operative to effect rotation of the spring adjustment screw 130. Rotation of this screw effects vertical movement of the nut 126 which is restrained against rotation relative to the screw to which it is threaded by the spring adjustment bearing plate 120 which rests atop the screw. Consequently, rotation of the knob effects vertical adjustment of the nut and of the spring adjustment bearing plate 120 which rests atop the nut. This vertical movement is operative to vary the preload of the spring or the breakaway torque required to effect compression of it.

In order to lock the top turn or top revolution 114 of the spring 28 to the seat plate 26, there is a striker 170 fixedly attached to the rear of the seat plate. This striker 170 has an oblong horizontal bore 172 extending therethrough through which the top turn 114 of the spring passes. A vertical extension 174 of this striker is secured by a screw 171 to the flange 90 of the seat plate 26 with a hook-shaped finger 176 of the striker wrapping around the horizontally extending flange 96 of the seat plate.

Lockout Means

The lockout means 32 comprises a lockout pawl 180 engageable with either of two flats 182, 183 on the rearside of the striker 170 to prevent movement of the seat plate 26 and the attached striker 170. The pawl 180 has a hub 184 keyed to the inner end section 181 of the rotatable lockout lever 66. This lever is rotatable within the pivot tube 58 through which it extends from one side of the base plate 25. From the inner end section 181, the lever 66 extends laterally through a hole 64 of the base plate to a forwardly and outwardly extending section 186 and a laterally extending outer end section 188. The laterally extending outer end section 188 extends beyond the side of the seat and terminates in a paddle or grip 190 fixedly keyed to the outer end of the lever 66.

With reference to FIGS. 4 and 7, it will be seen that the inner end 181 of the lever 66 extends into a central bore 194 of the hub 184 of the pawl 180 and is secured thereto by a taper pin or roll pin 196. This taper pin extends through the lockout lever and through the hub of the pawl 180. Additionally, an extension of the taper pin extends into a generally arcuate detent slot 198 of the gusset plate 50. Thus, the taper pin 196 functions not only to hold the pawl attached to the lever arm 66, but also functions as a detent to hold the lever arm in either a raised or lowered position of the lever arm. In the raised position of the lever arm, the locking pawl 180 engages either the underside flat surface 182 or the flat surface 183 of the striker plate and locks the seat plate 26 against further rearward pivotal movement on the base plate 25. In the lowered position of the lever, the taper pin 196 engages another portion of the slot 196 and locks the lever arm 66 in a lowered position whereat the pawl is disengaged and out of alignment with the striker plate such that the striker plate and chair seat plate attached thereto may pass the pawl to permit pivoting movement of the seat plate relative to the base plate.

Gas Actuator Means

The gas actuator means 34 comprises a pawl 200 engageable with the gas actuator button 36 of a gas cylinder (not shown) to control extension and retraction of the spindle 14 of the chair. This pawl is normally maintained in the position illustrated in FIG. 5 whereat the pawl is disengaged from the actuator button. However, when the gas actuator lever 68 secured to that pawl is lifted, it causes the pawl 200 to engage the button 36 so as to facilitate raising or lowering of the chair seat.

To effect this movement of the pawl 200, the pawl has a hub 202 mounted over the inner end 206 of the lockout lever 68. The hub 206 of the pawl is secured to the end of the lever by a taper pin 212, one end 214 of which extends through a hole 216 in the gusset plate 50. Unlike the taper pin 196, the taper pin 212 rides freely in the hole 216 and does not function as a detent to maintain the lever 68 in either one of two positions. It does, though, function as a stop to limit rotation of the lever 68, the weight of which usually maintains the gas actuator pawl 200 in the position illustrated in FIG. 5 whereat it is disengaged from the button 36.

From the inner end 206 of the locking lever 68, the lever extends laterally through the lever pivot tube 56 and hole 62 in the base plate 26 to a forwardly and outwardly extending section 222, which forwardly and outwardly inclined section terminates in a laterally extending section 224. On the end of the laterally extending section 224 there is a paddle-shaped handle 226 secured thereto. When this paddle 226 is lifted, it results in the gas actuator pawl 200 being moved downwardly into engagement with the actuator button 36 of the gas cylinder which controls raising and lowering of the seat of the chair.

Tilt Angle Adjustment Means

With reference now to FIGS. 5 and 5A it will be seen that there is a tilt angle adjustment means 37 mounted on the front of the control. This tilt angle adjustment means 37 includes a rotatable bumper 232 movable between two positions, in either one of which it serves as a bumper or stop against which the underside of the front channel 110 of the seat plate 26 abuts when in the at-rest position of the seat plate relative to the base plate. This at-rest position is the position toward which the seat plate is biased by the spring 28. In one position of the bumper 232, that position illustrated in FIG. 5, the top surface 27 of the chair seat plate is maintained in a horizontal or 0° at-rest position. In the other (FIG. 5A) of the two positions of the bumper, the bumper is rotated into a position of greater height whereat the seat plate is tilted to a position at which the top surface 27 of the seat plate slopes downwardly and rearwardly at an angle of 5° relative to a horizontal plane. This is the conventional rest position of the seat. Many keyboard operators, though, prefer to maintain the seat at the 0° or horizontal setting when seated for a long period of time before a keyboard. To effect this rotational movement of the bumper 232 between the two positions illustrated in FIGS. 5 and 5A, the bumper 232 comprises two end sections (FIG. 4) 232*a*, 232*b* rotatably connected to the side flange sections 92, 94 of the base plate. These two end sections of the bumper 232 are connected by a center section 234. This center section has a forwardly extending lever 236 extending through a slot 238 at the forward end of the base plate 25. The lower end of this lever 236 has a laterally extending lever arm secured thereto. The lever arm 240 terminates in a handle 242. When the chair seat is tilted rearwardly by a person seated in the chair, the handle 242 may be grasped and oscillated to effect rotation of the bumper 232 between either of its two positions. The bumpers 232*a*, 232*b* are mounted for rotation in side channels 244 of the side sections of the flange 52 for movement between the two bumper stop positions. Effectively, then, the bumper 232 presents two different stop surfaces to the underside of the seat plate 26, which surfaces are of differing height from the base plate 25 and therefore change the at-rest angulation of the seat plate, depending upon which of the two surfaces is engaged with the underside of the channel 110 of the seat plate 26.

As an alternative to the use of the lever arm 240 and handle 242 to effect rotation of the bumper 232, an extension of the bumper may be passed through one side section of the flange 52 of the base plate and connected to a handle for directly rotating the bumper about its pivot axis.

Cover and Finger Guard

In order to improve the appearance of the chair control 10, and to prevent fingers from inadvertently being inserted into movable portions of the mechanism of the control, there is a molded plastic cover 250 (FIG. 5) located over the rear section of the base plate 25. This cover 250 is of the same peripheral contour as the rear section of the flange 52 of the base plate 25 and rests atop that rear section. It is secured to the base by a screw 254 which extends through a hole 252 of the cover 250 and is threaded into a threaded bore 256 of the gusset 50.

To further protect against injury and inadvertent insertion of fingers between the front of the seat plate 26 and the base plate 25, there is a finger guard 260 (FIG. 5) mounted on the front of the channel 110 of the seat plate 26. This finger guard is made from molded or extruded plastic and has a channel or groove 262 formed therein and adapted to be received over and secured to an upstanding flange 264 of the channel 110 of the seat plate 26. A lip 266 of the finger guard 260 extends forwardly and downwardly over the front of the base plate 25. This lip prevents fingers from being inserted between the front of the base plate and the channel 110 of the seat plate 26 or the bottom of the seat 18.

Operation of the Chair Control

Assuming that the lockout pawl 180 of the lockout means 32 is disengaged from the striker 170 of the seat plate 26, the chair seat 18 is free to rotate about the pivot axis 24 when a person seated in the chair leans backwardly against the backrest 20. When a person leans against the backrest, it results in the seat plate 26 pivoting about the pivot axis 24 and forcing the seat plate downwardly to compress the conical helical compression spring 28. In the course of compression of the spring, the spring adjustment bearing plate 120, against which the lower end of the spring rests, pivots on the arms or wings 122, 124 of the spring adjustment nut 126 against which the bearing plate 120 rests. This tilting of the spring adjustment bearing plate 120 enables the spring to compress while the axis of the spring moves toward and away from the axis of the spring adjustment screw 130. Without this tilting of the bearing plate 120, the spring life would be substantially reduced because of the additional stress created on the extreme outer fibers of the spring. The pivotal movement of the spring adjustment bearing plate accommodates this arcuate movement of this spring without overstressing the spring.

As the seat pivots about the pivot axis 24 to its extreme position—whereat the top surface 27 of the seat plate 26 is tilted at an angle of approximately 20 degrees to the horizontal—the rear of the seat plate 26 and the striker 170 move downwardly until the bottom surface 183 of the striker contacts a resilient pad 33 attached to the inside surface of the base plate 25. In the course of this movement, the top turn or top revolution 114 of the conical helical compression spring 28 passes through or over the other turns or coils until, in its fully compressed state, the top turn of the coil has passed over the bottom turn or coil 112. Otherwise expressed, the bottom small diameter turn or revolution passes through the top turn in the course of fully compressing the spring. As a consequence of this ability of the spring 28 to compress for a distance greater than the height of the spring, the profile of the control may be substantially reduced over any compression spring which would bottom out or not permit this travel of the spring for a distance greater than the height of the spring.

The force required to effect breakaway of the seat from its at-rest position to a tilted condition is controlled by adjustment of the preload of the spring. This is effected by rotating the adjustment knob of the spring so as to effect movement of the nut 126 over the length of the spring adjustment screw 130. This rotation effects movement of the screw either toward or away from the base plate so as to vary the preload of the spring, and thus the force required to effect tilting of the chair seat and breakaway of the chair seat from its at-rest position.

If the occupant of the chair desires to fix the chair seat in either a horizontal position or a position whereat it is inclined rearwardly at an angle of 5° relative to the horizontal, the occupant of the chair can lean backwardly so as to disengage the front of the seat plate 26 from the bumper 232 mounted on the base plate 25. With the front channel 110 of the seat plate disengaged from the bumper, the tilt angle adjustment lever arm 240 may be moved by the handle 242 between either a high elevation or low elevation position. In the low elevation position of the bumper 232, illustrated in FIG. 5, and with the seat plate engaged with the bumper, the top surface of the chair seat is in a horizontal position, while in the high position of the bumper, illustrated in FIG. 5A, the top surface 27 of the chair seat plate is inclined downwardly and rearwardly at an angle of 5°.

If the height of the chair is to be changed, the chair occupant may simply lift the paddle 226 so as to cause the gas actuator pawl 200 attached thereto to engage the actuator button 36 of a gas cylinder contained in the spindle to effect extension and retraction of the spindle, as is conventional in the pedestal chair art.

While we have described only a single preferred embodiment of our invention, persons skilled in the art to which this invention pertains will appreciate changes and modifications which may be made without departing from the spirit of our invention. Therefore, we do not intend to be limited except by the scope of the following appended claims:

We claim:

1. A chair comprising a base, a spindle extending vertically from the base, a knee-tilt chair control mounted atop said spindle, said control comprising a base plate, said base plate having a spindle mount located at the rear of said base plate and a horizontal pivot axis at the front of said base plate, a chair seat plate mounted upon said base plate for pivoted movement about said horizontal pivot axis, a low profile, conical helical compression spring located between said base plate and seat plate and operable to bias said seat plate to an at-rest position relative to said base plate, said spring being supported from said base plate and located between said horizontal pivot axis at the front of said base plate and said spindle mount at the rear of said base plate, said low profile, helical compression spring having a large diameter coil at one end and a small diameter coil at the opposite end, said small diameter coil of said spring being movable through said large diameter coil in the course of fully compressing said spring during tilting movement of said chair seat plate relative to said base plate, said small diameter coil of said spring being supported from said chair base plate, said large diameter coil being at least partially surrounded by and contained within a striker, said striker being engageable with said chair seat plate to limit tilting of said chair seat plate relative to said base plate, and extending through a hole in said striker, and said striker being fixedly secured to said chair seat plate.

2. A chair comprising a base, a spindle extending vertically from the base, a knee-tilt chair control mounted atop said spindle, said control comprising a base plate, said base plate having a spindle mount located at the rear of said base plate and a horizontal pivot axis at the front of said base plate, a chair seat plate mounted upon said base plate for pivoted movement about said horizontal pivot axis, a low profile, conical helical compression spring located between said base plate and seat plate and operable to bias said seat plate to an at-rest position relative to said base plate, said spring being supported from said base plate and located between said horizontal pivot axis at the front of said base plate and said spindle mount at the rear of said base plate, said low profile, helical compression spring having a large diameter coil at one end and a small diameter coil at the opposite end, said small diameter coil of said spring being movable through said large diameter coil in the course of fully compressing said spring during tilting movement of said chair seat plate relative to said base plate, said small diameter coil of said spring being supported from said chair base plate, said large diameter coil being at least partially surrounded by and contained within a striker, said striker being engageable with said chair seat plate to limit tilting of said chair seat plate relative to said base plate, and lockout means, said lockout means being movable between a first position wherein said lockout means is engageable with said striker to prevent tilting movement of said chair seat plate relative to said base plate and a second position wherein said locking means is disengaged from said striker and said chair seat plate is free to tilt relative to said base plate about said horizontal pivot axis of said base plate.

3. The chair of claim 2 wherein said lockout means comprises a locking pawl engageable with said striker and mounted upon a rotatable shaft, said rotatable shaft being mounted upon said base plate and extending laterally from beneath said chair seat plate to one side of said seat plate, and an activating lever secured to said shaft at said one side of said seat plate.

4. The chair of claim 3 which further includes a second pawl engageable with a gas cylinder of said spindle to control extension and retraction of said spindle, said second pawl being mounted upon a second rotatable shaft, said second rotatable shaft being mounted upon said base plate and extending laterally from beneath said chair seat plate on a side of said seat plate opposite from said one side, and an activating lever secured to said shaft on said opposite side of said seat plate.

5. The chair of claim 2 which further includes a tilt select bumper mounted between said chair seat plate and said base plate forwardly of said horizontal pivot axis of said base plate.

6. The chair of claim 5 in which said tilt select bumper is rotatable between two positions about a horizontal bumper axis, said bumper being of differing heights relative to said base plate in said two positions such that the at-rest tilt angle of said chair seat plate relative to said base plate may be varied by changing the position of said tilt select bumper.

7. The chair of claim 6 wherein said tilt select bumper is rotatably mounted upon said base plate, said bumper having a tilt select control lever extending laterally from said bumper on one side of said chair seat plate.

8. The chair of claim 7 wherein said bumper is rotatably mounted upon said base plate for rotation about a bumper pivot axis, said bumper pivot axis being located on said base plate forwardly of said horizontal pivot axis of said base plate.

9. The chair of claim 8 wherein said tilt select control lever extends laterally from said bumper to one side of said chair seat plate, said chair control lever being located forwardly of said bumper pivot axis.

10. A knee-tilt chair control for use in a pedestal base chair, said control being adapted to be mounted atop a vertical spindle of said chair, said control comprising a base plate, said base plate having a spindle mount located at the rear of said base plate and a horizontal pivot axis at the front of said base plate, a chair seat plate mounted upon said base plate for pivoted movement about said horizontal pivot axis, a low profile, conical helical compression spring located between said base plate and seat plate and operable to bias said seat plate to an at-rest position relative to said base plate, said spring being supported from said base plate and located between said horizontal pivot axis at the front of said base plate and said spindle mount at the rear of said base plate, said low profile, helical compression spring having a large diameter coil at one end and a small diameter coil at the opposite end, said small diameter coil of said spring being movable through said large diameter coil in the course of fully compressing said spring during tilting movement of said chair seat plate relative to said base plate, said small diameter coil of said spring being supported from said chair base plate, said large diameter coil being at least partially surrounded by a striker, said striker being engageable with said chair seat plate to limit tilting of said chair seat plate relative to said base plate, and extending through a hole in said striker, and said striker being fixedly secured to said chair seat plate.

11. A knee-tilt chair control for use in a pedestal base chair, said control being adapted to be mounted atop a vertical spindle of said chair, said control comprising a base plate, said base plate having a spindle mount located at the rear of said base plate and a horizontal pivot axis at the front of said base plate, a chair seat plate mounted upon said base plate for pivoted movement about said horizontal pivot axis, a low profile, conical helical compression spring located between said base plate and seat plate and operable to bias said seat plate to an at-rest position relative to said base plate, said spring being supported from said base plate and located between said horizontal pivot axis at the front of said base plate and said spindle mount at the rear of said base plate, said low profile, helical compression spring having a large diameter coil at one end and a small diameter coil at the opposite end, said small diameter coil of said spring being movable through said large diameter coil in the course of fully compressing said spring during tilting movement of said chair seat plate relative to said base plate, said small diameter coil of said spring being supported from said chair base plate, said large diameter coil being at least partially surrounded by a striker, said striker being engageable with said chair seat plate to limit tilting of said chair seat plate relative to said base plate, and lockout means, said lockout means being movable between a first position wherein said lockout means is engageable with said striker to prevent tilting movement of said chair seat plate relative to said base plate and a second position wherein said lock-out means is disengaged from said striker and said chair seat plate is free to tilt relative to said base plate about said horizontal pivot axis of said base plate.

12. The chair control of claim 11 wherein said locking means comprises a locking pawl engageable with said striker and mounted upon a rotatable shaft, said rotatable shaft being mounted upon said base plate and extending laterally from beneath said chair seat plate to one side of said seat plate, and an activating lever secured to said shaft at said one side of said seat plate.

13. The chair control of claim 12 which further includes a second pawl adapted to engage an actuator of a gas cylinder to control raising and lowering of said chair control, said second pawl being mounted upon a second rotatable shaft, said second rotatable shaft being mounted upon said base plate and extending laterally from beneath said chair seat plate on a side of said seat plate opposite from said one side, and an activating lever secured to said shaft on said opposite side of said seat plate.

14. The chair control of claim 11 which further includes a tilt select bumper mounted between said chair seat plate and said base plate forwardly of said horizontal pivot axis of said base plate.

15. The chair control of claim 14 in which said tilt select bumper is rotatable between two positions about a horizontal bumper axis, said bumper being of differing heights relative to said base plate in said two positions such that the at-rest tilt angle of said chair seat plate relative to said base plate may be varied by changing the position of said tilt select bumper.

16. The chair control of claim 15 wherein said tilt select bumper is rotatably mounted upon said base plate, said bumper having a tilt select control lever extending laterally from said bumper on one side of said chair seat plate.

17. The chair control of claim 16 wherein said bumper is rotatably mounted upon said base plate for rotation about a bumper pivot axis, said bumper pivot axis being located on said base plate forwardly of said horizontal pivot axis of said base plate.

18. The chair control of claim 17 wherein said tilt select control lever extends laterally from said bumper to one side of said chair seat plate, said chair control lever being located forwardly of said bumper pivot axis.

19. The chair control of claim 11 wherein said lock-out means includes a pawl movable between two positions, said pawl in one of said positions being engageable with at least one surface of said striker to prevent tilting movement of said chair seat plate relative to said base plate and in the other position being disengaged from said striker with said chair seat plate free to tilt relative to said base plate about said horizontal pivot axis of said base plate.

20. The chair control of claim 19 wherein said locking pawl is mounted upon a rotatable shaft, said rotatable shaft being mounted upon said base plate and extending laterally from beneath said chair seat plate to one side of said seat plate, and an activating lever secured to said shaft at said one side of said seat plate.

21. A knee-tile chair control for use in a pedestal base chair, said control being adapted to be mounted atop a vertical spindle of the chair, said control comprising a base plate, said base plate having a generally horizontal rear section and an upwardly and forwardly inclined front section, said base plate having a spindle mount in the rear section of said base plate and a horizontal pivot axis at the front of said front section of said base plate, a chair seat plate mounted upon said base plate for pivoted movement about said horizontal pivot axis at the front of said front section of said base plate, a low profile, conical helical compression spring located between said base plate and seat plate and operable to bias said seat plate to an at-rest position relative to said base plate, said spring being supported from said base plate and located between said horizontal pivot axis at the front of said base plate and said spindle mount at the rear of said base plate, said low profile, conical helical compression spring having a large diameter coil at its upper end and a small diameter coil at its lower end, a cup-shaped depression in said base plate, said depression having a bore formed in the center thereof, adjusting means for adjusting the compression of said spring, said adjusting means includes an adjustment screw passing through said bore of said depression, said adjustment screw having a lower end extending beneath said depression in said base plate, a spring adjustment knob mounted on the lower end of said adjustment screw, said adjustment knob being cored out in the center thereof such that said adjustment knob fits over said depression of said base plate to provide a low profile on said control and a large surface area on said knob for facilitating adjustment of said spring compression, said adjusting means including a spring compression adjusting nut secured to the upper end of said screw, said nut being at least partially movable into said depression of said base plate during adjustment of the compression of said spring, and said adjusting means further including a spring support plate, said small diameter coil of said spring resting atop said spring support plate, said spring support plate being pivotally supported on said spring compression adjusting nut, and said large diameter coil of said spring being movable over said small diameter coil and said spring support plate in the course of fully compressing said spring during tilting movement of said chair seat plate relative to said base plate.

* * * * *

UNITED STATES PATENT AND TRADEMARK OFFICE

CERTIFICATE OF CORRECTION

PATENT NO. : 4,948,198

DATED : August 14, 1990

INVENTOR(S) : Philip Crossman et al.

It is certified that error appears in the above-identified patent and that said Letters Patent is hereby corrected as shown below:

Col. 10, line 55, before "extending" insert --said large diameter coil--.

Col. 12, line 34, before "extending" insert --said large diameter coil--.

Signed and Sealed this

First Day of September, 1992

*Attest:*

DOUGLAS B. COMER

*Attesting Officer*

*Acting Commissioner of Patents and Trademarks*